US008281518B2

(12) United States Patent
Marocco

(10) Patent No.: US 8,281,518 B2
(45) Date of Patent: Oct. 9, 2012

(54) LOUVRE CONTROL SYSTEM

(75) Inventor: Mario M. Marocco, Toronto (CA)

(73) Assignee: Maxxmar Inc., Toronto, Ontario (CA)

( * ) Notice: Subject to any disclaimer, the term of this patent is extended or adjusted under 35 U.S.C. 154(b) by 306 days.

(21) Appl. No.: 12/656,791

(22) Filed: Feb. 17, 2010

(65) Prior Publication Data

US 2011/0197513 A1 Aug. 18, 2011

(51) Int. Cl.
*E06B 7/096* (2006.01)

(52) U.S. Cl. ..... 49/82.1; 49/74.1; 49/403

(58) Field of Classification Search ..... 49/74.1, 49/79.1, 82.1, 86.1, 403
See application file for complete search history.

(56) References Cited

U.S. PATENT DOCUMENTS

| | | | | |
|---|---|---|---|---|
| 3,156,956 | A * | 11/1964 | Jacobson | 49/87.1 |
| 3,205,541 | A * | 9/1965 | Beards | 49/371 |
| 3,375,608 | A * | 4/1968 | Thompson | 49/403 |
| 5,794,380 | A * | 8/1998 | Guardia | 49/74.1 |
| 6,098,340 | A * | 8/2000 | Francis | 49/74.1 |
| 6,675,534 | B2 * | 1/2004 | Marocco | 49/86.1 |
| 6,810,621 | B1 * | 11/2004 | Ricci | 49/90.1 |
| 7,389,609 | B2 * | 6/2008 | Yorgason | 49/82.1 |
| 2003/0136053 | A1 * | 7/2003 | Norbert | 49/74.1 |
| 2005/0076569 | A1 * | 4/2005 | Griffiths et al. | 49/82.1 |

* cited by examiner

*Primary Examiner* — Jerry Redman

(57) ABSTRACT

A shutter having a rectangular frame with side members and end members, and in which at least one of the side members is hollow, and a plurality of louvres extending from one side member to the other side member, and being rotatably mounted in the side members, and a control linkage within at least one of the side members, the control linkage having at least one control element, and each louvre having at least one control member engaging the respective control element, the control members being located spaced radially from the rotation axes of the louvres.

12 Claims, 8 Drawing Sheets

LOUVRE CONTROL SYSTEM

FIELD OF THE INVENTION

The invention relates to shutters for windows and doors, having louvres which are rotatable between open and closed positions, and which are mounted in a rectangular frame. The frame is hollow, and contains control mechanism for operating the louvres to rotate them, and to hold them in a preset position.

BACKGROUND OF THE INVENTION

The provision of shutters having a rectangular frame and louvres, is well known. Such louvres may be opened to admit light, or closed to restrict light. In the simplest form of such shutters a louvre control bar was connected to all of the louvres, and movement of the bar operated all the louvres in unison. In more advanced forms of shutter design, the shutter frame is hollow, and the louvre control mechanism is concealed within the hollow frame of the shutter. A manual control may be located on one of the side frames, by which the mechanism may be operated so as to rotate all of the louvres between open and closed positions. In addition, by the provision of a louvre control mechanism of this type it is possible to provide a frictional restraint, so that once the louvres have been set in a desired position, they will remain in that position until they are manually reset. This provides a further appeal to the consumer.

Numerous designs have been proposed for such concealed louvre operating mechanisms. One recent example is in U.S. Pat. No. 6,810,621, issued Nov. 2, 2004, inventor Fernando Ricci, entitled Friction Brake for Louvre Structures.

In this example, the side members of the shutter frame are hollow. The louvres were provided with axles at each end, which extended through openings in the hollow side frames. Within one of the side frames a mechanism was located by which all of the louvres were connected and would rotate in unison. In this example, there is no disclosures of a separate manual operating knob or control. The louvres were presumably moved from one position to another simply by holding one of the louvres in the finger and thumb and rotating it. However, manual operating devices for such controls are well known.

The design of this particular type of louvre control mechanism was relatively complex, and required some considerable degree of dexterity in assembling the various parts. A more serious disadvantage however was the difficulty of arranging the spaces between the axes of the adjacent louvres.

Preferably when such shutters are made, such louvres can be spaced with their axes a greater or lesser distance apart. This variable spacing is desirable since a customer may have windows, or doors, which may vary in height. They may require a greater or lesser number of louvres. In each case the actual spacing of the louvres may be a custom function, in order to provide a shutter which accommodates the particular windows of a particular home. In some cases in the past this problem has been addressed by simply providing top and bottom frame members, and varying the width of the top and bottom frame members. This system however is not entirely satisfactory and may provide an unaesthetic appearance or variation in appearance between various different shutters in a home. It is desirable to provide for the ability to construct the shutter, with the louvres at predetermined displacement from one another, depending upon the requirements of a customer. This has not been possible in prior art designs. One solution is shown in U.S. Pat. No. 6,675,534, N Marocco, Issued, Jan. 13 2004. However, this was a relatively complex system requiring hand adjustments. It is also desirable to incorporate some form of frictional resistance in the operating mechanism, in a simple and effective manner, so that the louvres will remain in the particular angular orientation selected by the home owner.

One of the problems in making shutters is that they must usually be made to custom measurements to fit the size of a particular window or door opening.

The shutter louvres are made in predetermined widths. In order to fit a certain window opening, louvres must be selected, by width. Then they must be set in the frame at predetermined spacings. The edges of the louvres must overlap, to be effective. But they should not overlap too far.

It is thus necessary to select the both the best width of louvre, and also the best number of louvres for a specific shutter. The frames must then be made with openings to accept louvres pivots, at spacings which will achieve the desired degree of overlap, when the louvres are swung closed.

Then when that has been determined, the operating mechanism within the frame must also be set to the same spacings are the louvre pivot openings.

In U.S. Pat. No. 6,675,534, this adjustment required that the mechanism connecting the louvres had to be manually adjusted, and fastened, to achieve the correct spacing.

This clearly was undesirable. It involved increased manufacturing time, and cost. It also involved the possibility that, over time, the manual adjustment might become loose, and the shutter would then require repair.

It is desirable to provide a connecting mechanism, contained within the shutter frame, which is self centering during manufacture and requires no manual adjustment.

BRIEF SUMMARY OF THE INVENTION

With the view to providing a shutter satisfying these objectives, the invention comprises a shutter having a rectangular frame with side members and end members, and in which at least the side members are hollow, and a plurality of louvres extending from one side member to the other side member, and being rotatably mounted in the side members, and a control linkage within at least one of the side members, the control linkage having at least one elongated control element, and each louvre at the said at least one end having a rotary driven member and having at least one drive member engaging the at least one control element, and the driven member of each louvre. Preferably there will be two such drive members for each louvre, engaging said driven member on opposite sides, and there will be two such control elements connecting with respective said drive members.

Preferably, the louvre will be provided with end axles extending outwardly from each end of the louvre, and extending into suitable openings in the side frames, and on at least one end, the end axle having a coupling plate attached thereto, and openings in the coupling plate and connections on the coupling plate, for connecting them to each of said shoes.

Preferably, the connections on the coupling plates will be in the form of openings in the coupling plates, and the shoes will have stub pins formed thereon, for frictional retention in said openings.

Preferably, the end axle at each end of each louvre will be an integrally formed unit, forming part of an end plug for closing each end of the louvre, with the end axle extending outwardly from the end plug.

In some circumstances the driven members can be mounted on the control plate along axes offset from 180 degs.

In another embodiment the driven element for each of the louvres may be in the form of a gear, and the drive member may be a sliding toothed rack, or there may be two such sliding racks, on opposite sides of the gear.

In this case slide housings are provided for housing the racks along which the racks may slide.

Preferable the sliding racks will be connected to the control element or elements. Preferably the louvre pivots will make a sliding fit in their respective gears, and fastening means will secure each pivot to its respective gear.

Preferably the connection between the racks and the control element or elements will comprise a drive pin on the rack and a drive pin hole in the control element.

The pinholes in the control element can thus be drilled out on spacings which are identical to the louvre pivot openings in the side frame.

The gears may be formed with keyed drive surfaces, and the louvre axles may be formed with mating surfaces. In this way the assembly of the system is greatly simplified. Indicia are also preferably formed on the gears and on the supports, to further assist in assembly.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
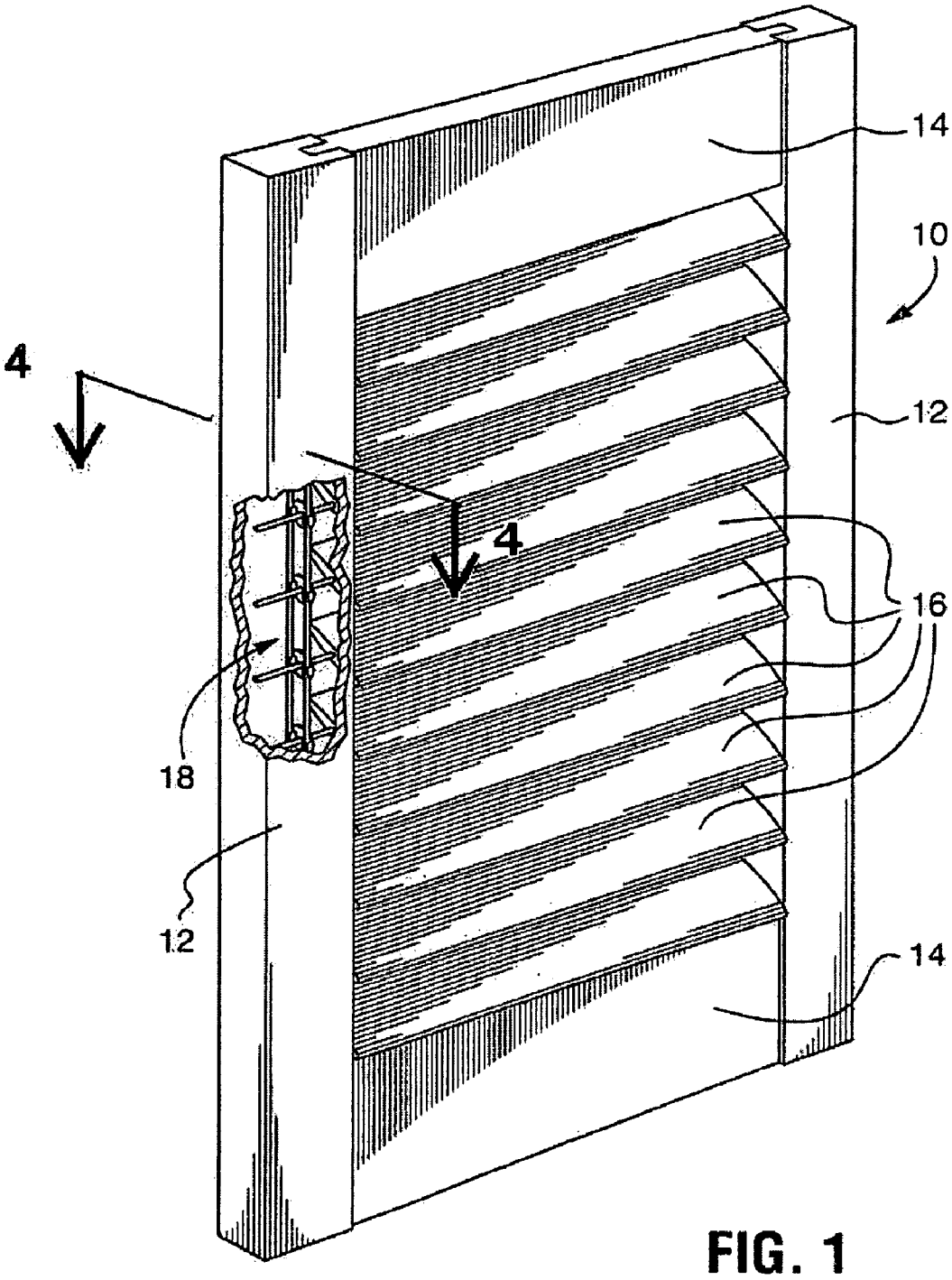
FIG. 1 is a perspective illustration of a typical shutter, partially cut away to reveal the interior.
Figure 2:
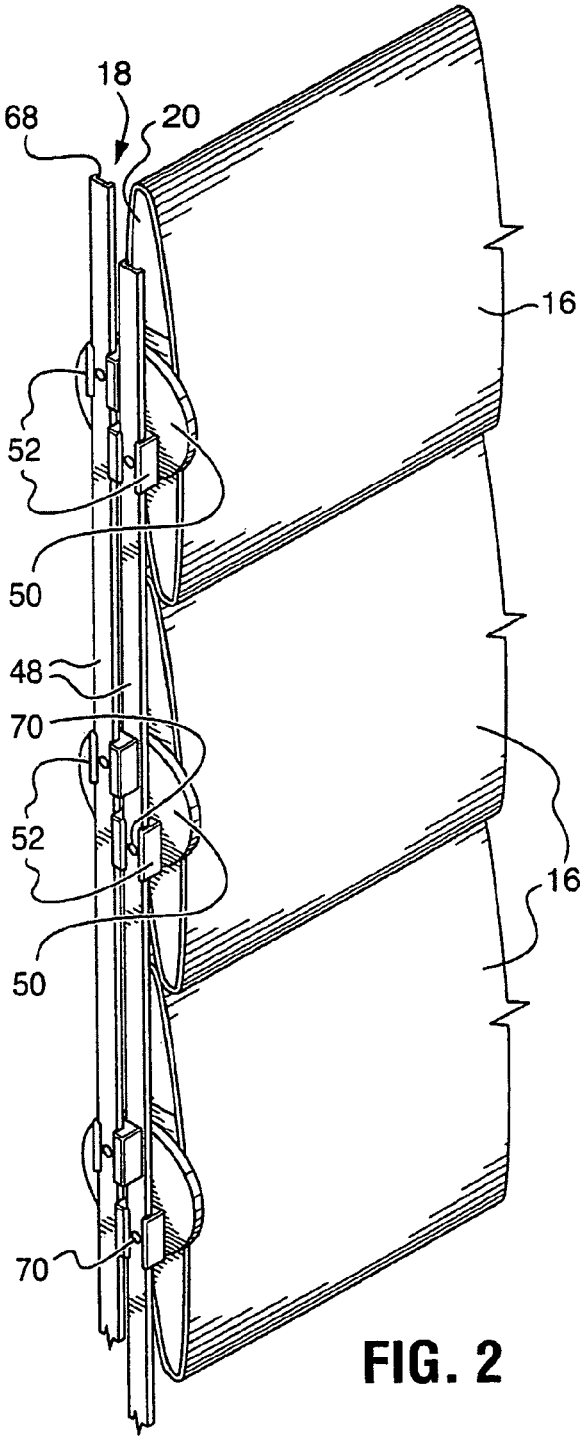
FIG. 2 is a perspective illustration of a group of louvres, showing the louvre operating mechanism, and connection shoes and coupling plates, with the louvres shown in an open position.
Figure 3:
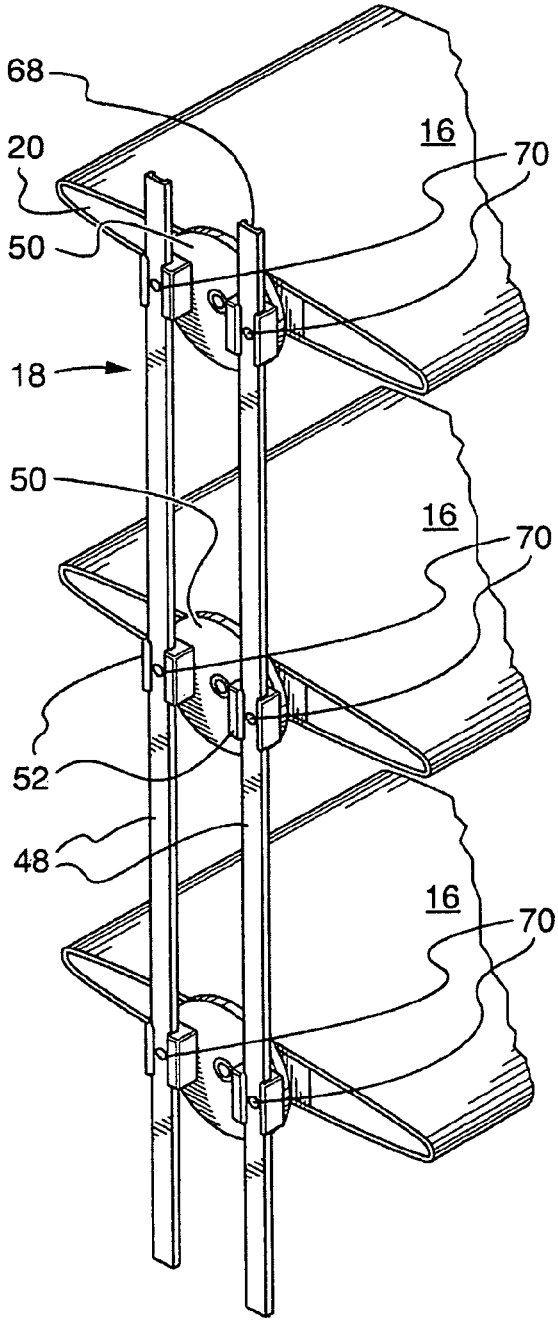
FIG. 3 is a perspective illustration corresponding to FIG. 2, and showing the louvres rotated into a closed position.

Referring first of all to FIG. 1, this illustrates a typical shutter (10). The typical shutter will have a rectangular frame consisting of two side frame members (12) and (12), and upper and lower frame end members (14) and (14). A plurality of louvres (16) are mounted between the side frame members (12, and extend horizontally, parallel to the top and bottom end frame members (14). The louvres are mounted in a manner described below, for rotation about their longitudinal axes.

The louvres are spaced apart along the side frame members. The number of louvres and the spacing between the louvres will depend upon the height of the shutter, which will in turn be determined by the height of the opening, either a window or a door, in which the shutter is to be placed. The louvres (16) in this embodiment are of hollow plastic construction, extruded in an aerofoil shape and having ends described below. As explained above, the invention provides an ability to arrange the spacing between the louvre axes, during the manufacturing stage. This enables the manufacturer to select the correct number of louvres in a particular shutter, so as to provide a pleasing aesthetic appearance for the customer. As is also explained above, the rotation of the louvres is controlled, so that they are all tilted in the parallel planes, when they are adjusted by the customer. Such adjustment should preferably be maintained in a pre-set position until the customer decides to change the louvres by opening them or closing them.

All of these functions are achieved, according to this invention, by the use of the control linkage (18), shown in more detail in FIGS. 2 to 7.

Figure 4:
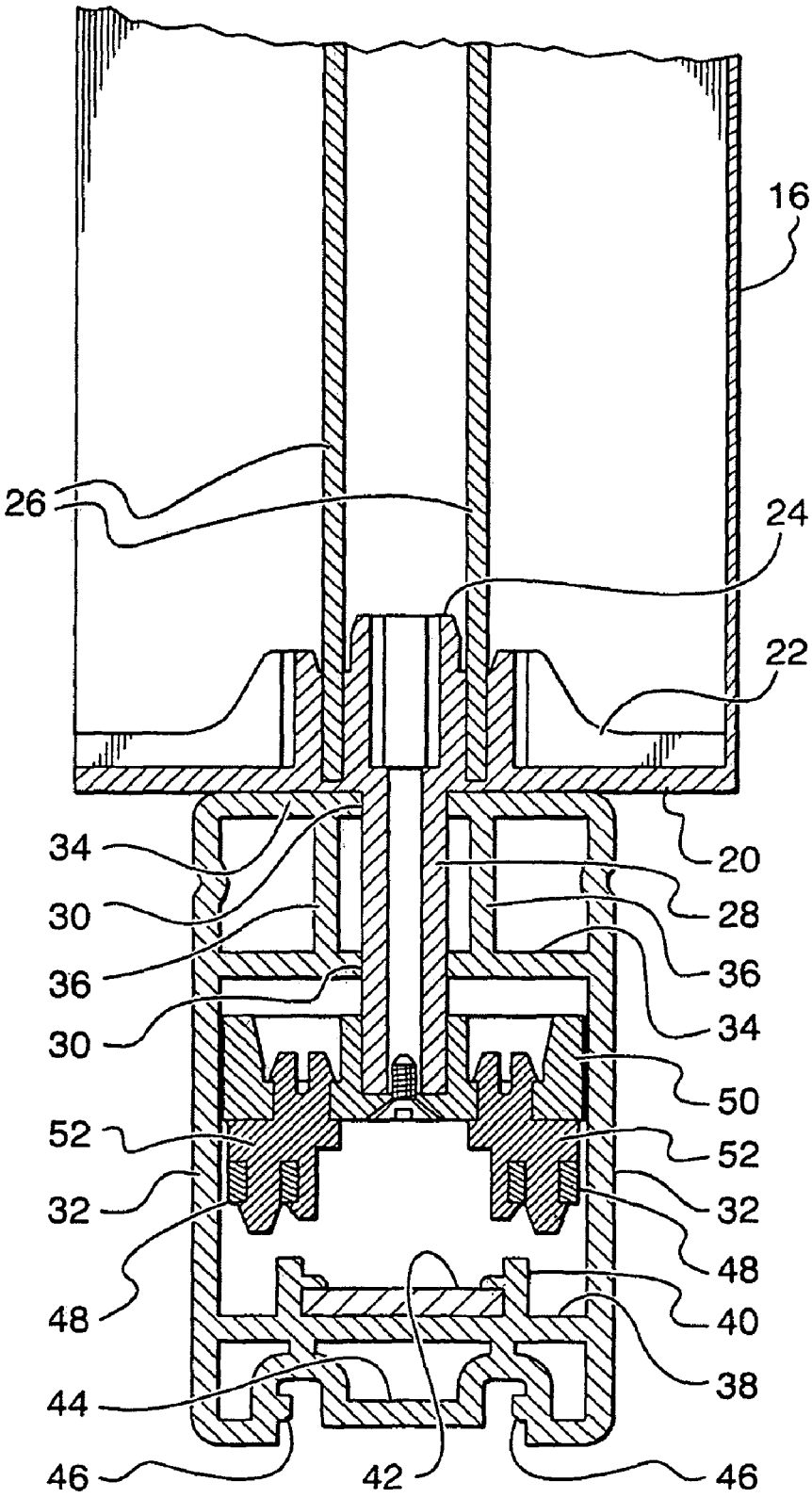
FIG. 4 is a section along the line 4-4 of FIG. 1.

As shown in FIG. 4, at each end of each louvre (16), the louvres are provided with end plug (20), formed with a male portion (22) which is shaped to fit within the interior of the end of the louvre (16). A central tubular portion (24) fits within the central walls (26) of the each louvre. These male portions are held in position by suitable adhesives applied during assembly. Extending outwardly from the end plug, there is an end axle (28), defining a tubular interior.

Each of the side frame members (12) is formed with a plurality of spaced part openings (30), for receiving respective axles (28). The spacing of the openings along the length of the side frame is calculated so as to provide the appropriate number of louvres (16) for a given shutter. In some cases it will be necessary to add one or two louvres and in other cases to reduce the number. In extreme cases it is possible to use louvres having a somewhat greater width. In any case, the spacing of the openings along the side frame members will be equal, as between openings, and in accordance with the invention, can be preset during manufacture to suit the requirements of a particular customer's installation.

Each of the side frame members is formed with parallel spaced apart side walls (32), and a plurality of transverse walls (34) extending between them.

The transverse walls (34) in turn define hollow tubular spaces. Bracing walls (36) extend between two of the transverse walls (34), so as to provide a secure tubular structure, for reception of the axles (28) of the louvres (16).

A third transverse wall (38) defines two retention walls (40), for retaining corner bracing elements (42), which are typical L shaped sheet metal members, bracing the corners of the frame to provide a secure structure. A connection wall (44) is formed between the two side walls (32), and defines two generally L shaped retention channels (46). The retention channels (46) permit the interconnection of an additional trim strip or extrusion (not shown) to add detail to the appearance of the side frame, or possibly to allow the side frame to be made somewhat deeper, for a particular customer's installation, or to provide a different look.

Two control elements (48) extend side by side within the interior of side frames (12) Coupling plates (50) are attached to the outward free ends of the axles (28), typically for example by means of screw fastenings or the like, or adhesive. The profile of the free end portions of the axles (28) may be non-circular, if desired, so as to ensure that the coupling plates remain in their correct orientation in relation to such end axles.

Figure 5:
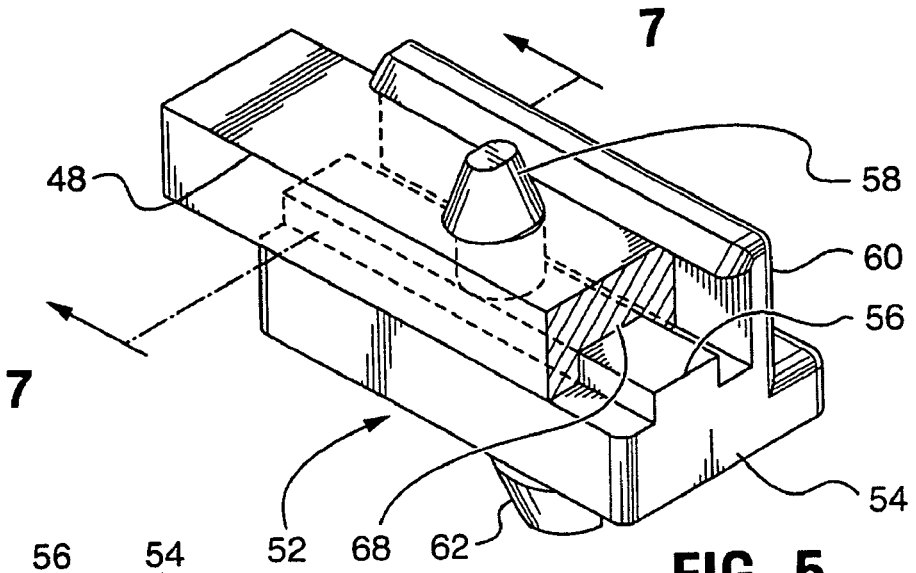
FIG. 5 is a perspective illustration of a control shoe, and showing in phantom a control element.
Figure 6:
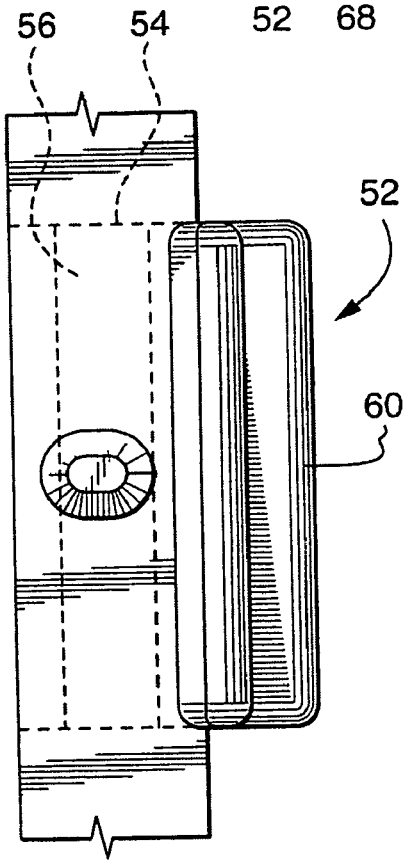
FIG. 6 is a top plan view of the connection shoe of FIG. 5.
Figure 7:
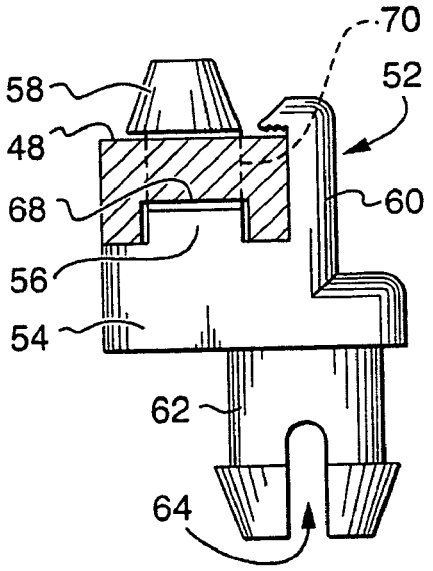
FIG. 7 is a section along the line 7-7 of FIG. 6.

On each coupling plate (28), there are two control shoes (52), (52) (FIGS. 5, 6 and 7). Each control shoe (52) comprises a main body (54), defining an axial rib (56). A retention pin (58) extends perpendicular to the rib (56) for reasons to be described. A holding wall (60) extends perpendicular from the main body (54) adjacent to the rib (56) for reasons to be described. On the side of the main body (54) remote from the rib (56), there is a stub pin (62).

Stub pin (62) is bifurcated as at (64), so as to permit it to flex in and spring out. Each of the stub pins (62) is captively received in a respective opening (66) in the respective coupling plate (50). Stub pins (62) are rotatable within their respective openings in their respective coupling plates (50), so that when the control elements (48) move, as described below, the stub pins (62) an rotate in their openings (66).

The resilient action of the bifurcations (64) in the stub pins (62) provides a certain degree of friction in the system. This has the advantage of providing a frictional brake, which holds all the louvres (16) in the planes in which they are set by the customer, until they are reset into another position. Other braking systems are possible as described in earlier patents.

The control elements or bars (48) consist of elongated control bars or rods of thermoplastic or metal, defining an axial groove (68). Elements (48) are adapted to mate with the rib (56) on the main body (54). Each of the control elements (48) is provided with a plurality openings (70).

These openings (70) fit over stub pins (62), and thus the control elements (48) interconnect all the coupling plates (50) together.

In this way when the customer moves any one of the louvres (16) all the louvres will move in unison. Alternatively, the control linkage (18) can be connected to some form of manual (or power operated) control. If power is provided then the power could be switched on/of from a remote location.

A wireless remote control can even be provided if desired.

During manufacture the spacing of the openings (30) in the side frames (12) will be computed and set to produce a shutter having the measurements and proportions specified in the order. The same spacing will also be used to set the locations of the openings (66) in the control elements (48).

Once these openings have been located and formed, the rest of the assembly proceeds the same way for any shutter using the invention.

It will be understood that various changes can be made.

For example the control elements could be flexible cables. In this case they would not be provided with openings. Instead the shoes (52) could be provided with some form of clamps (not shown) which could be tightened onto the cables.

The frictional braking effect for holding the louvres in a preset angle could be provided by some other means, for example, by some suitable formation on the end axles (28) themselves.

In some cases it may be possible to use only one control element. This element would function to both pull, in one direction, and to push in the opposite direction of rotation.

This might be somewhat less satisfactory than the two elements described, but could be adequate in some cases.

The control elements could be located, with one in one side frame, and the other on the other side frame.

Figure 9:
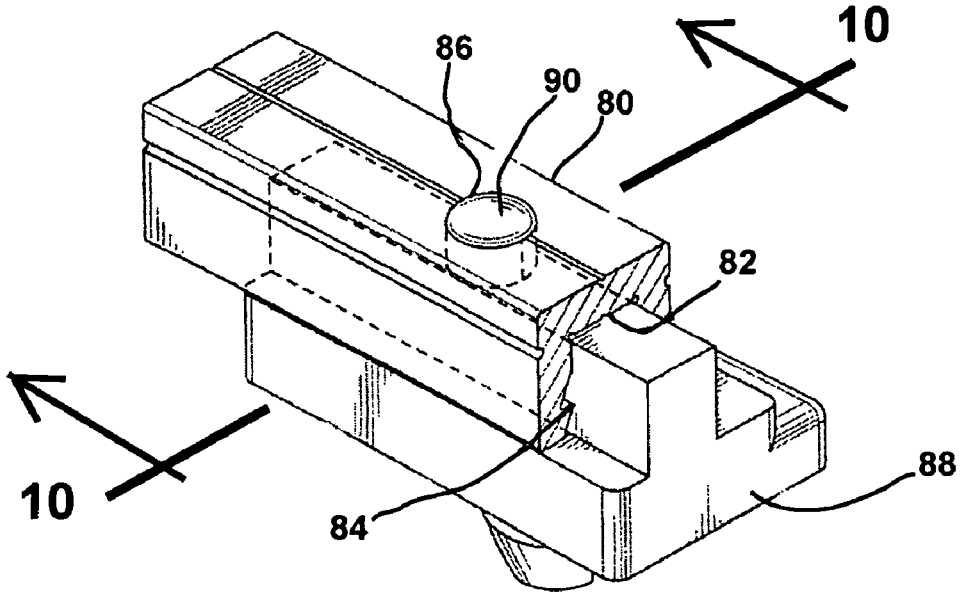
FIG. 9 is a perspective of the control bar and shoe.
Figure 8:
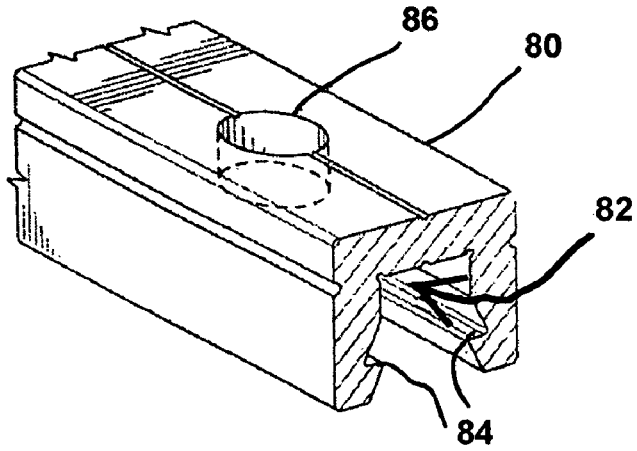
FIG. 8 is a perspective of a further embodiment of connecting bar.
Figure 10:
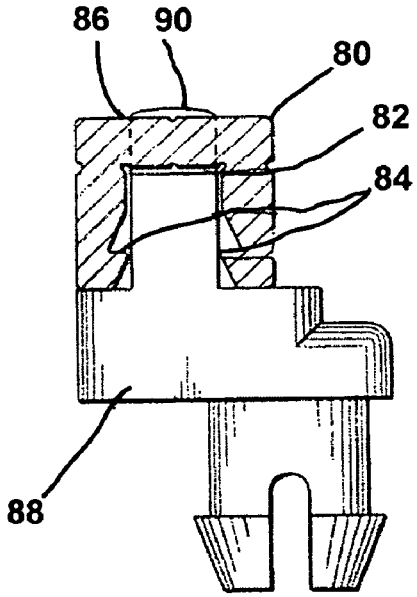
FIG. 10 is a section along the line 10-10 of FIG. 9.
Figure 11:
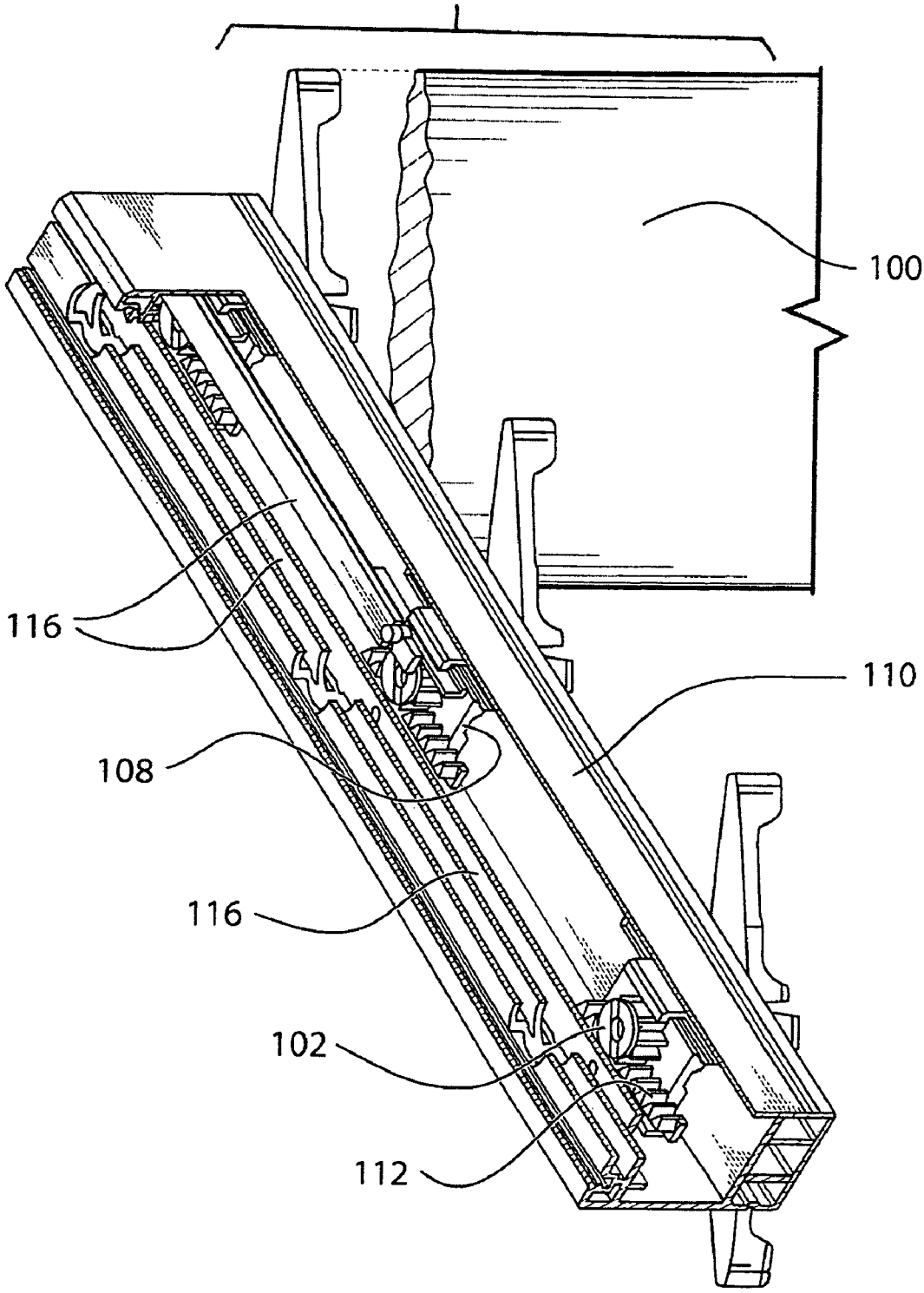
FIG. 11 is a perspective partly cut away of an alternate form of shutter with gears and racks for controlling the louvres.
Figure 12:
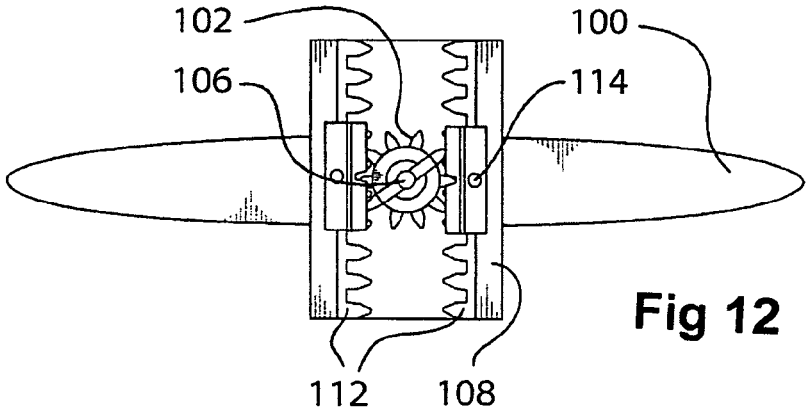
FIG. 12 is a perspective of a drive gear and two racks, and a housing, with the louvres in a closed position.
Figure 13:
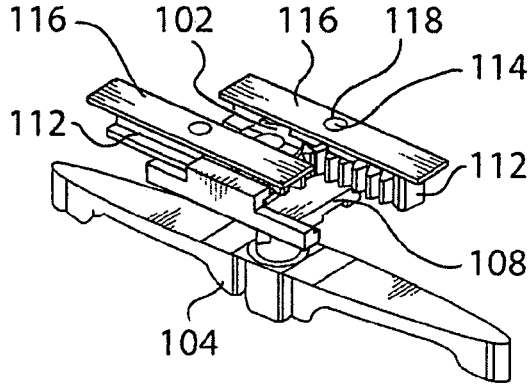
FIG. 13 is a plan view of a drive gear and two racks and a housing, with the louvres in a closed position.
Figure 14:
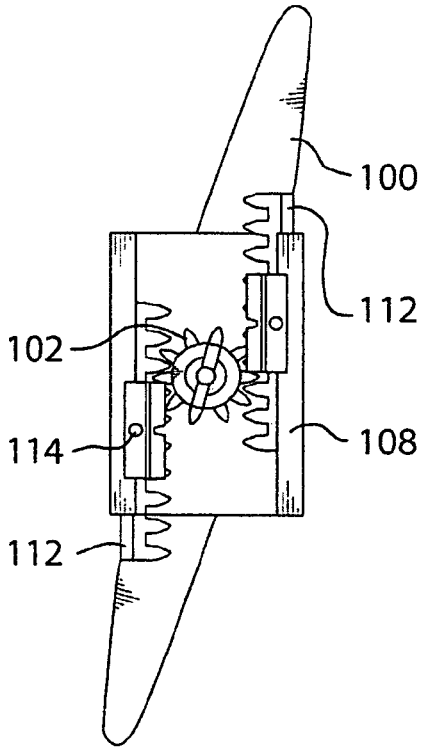
FIG. 14 is a plan view corresponding to FIG. 13 showing the louvres in an open position.

According to a further embodiment, shown in FIGS. 8, 9, and 10, the control element or bar, and shoe can be modified for easier assembly.

In this embodiment the control element or bar (80) is formed, typically of extruded thermoplastic material. Control bar (80) has a generally rectangular outer profile, and defines a channel (82). The side walls of channel (82) are formed with capture ribs (84).

Openings (86) are formed in control bar (80) as part of the assembly operation. The spacing of openings (86) will be determined by the spacing between the louvres (16). The shoes (88) are also modified. The retention wall (60) is now absent.

Locating pins (90) are provided in shoes (88) to fit in openings (86) in control bar (80). Once fitted together the capture ribs (84) grip the body (54) of shoe (88) and the pin (90) fits in opening (86).

Otherwise shoe (88) is similar to shoe (52) and has a stub pin (62) for interfitting in plate (50).

In some shutters the spacing, or dimension of the louvres may be such that it is difficult to achieve a full closure rotation.

The act of rotating fully closed may cause the control plates and shoes to go into a over centre position and be locked.

To avoid this the shoes may be attached to the control plates on axes which are offset from 180 degs.

This arrangement will allow full rotation for closure, in one direction, with out causing the parts to lock up.

Rotation in the other direction will not produce full closure. However this compromise will be acceptable to some consumers.

In accordance with a still further embodiment the control plates can be replaced with driven gears, driven by rack gears.

This embodiment is shown in FIGS. 11, 12, 13, and 14.

In this embodiment each louvre (100) is provided with a driven gear (102), secured to its end axle (104) by a screw (106). A gear housing (108) is provided for each louvre (100), concealed within side frame (110). Axle (104) passes into gear housing (108) and driven gear (102) secured to axle (104) is located within gear housing (108). Gear housing (108) is of generally three sided channel shape, and supports two drive racks (112). Drive racks (112) are slidable within gear housing (108) and engage driven gear (102) on opposite sides. Each drive rack (112) has a connector in the form of a drive pin (114).

Control elements (116) extend from top to bottom of the side frame (110), with some clearance at each end for movement. Control elements (116) are formed with drive pin holes (118) which receive drive pins (114), in a rotational grip. Movement of the control elements (116) will cause one of drive racks (112) in each gear housing (108) to slide in one direction, thus rotating driven gears (102). Rotation of driven gears (102) will cause the other of the drive racks (112) in each gear housing (108) to slide in the opposite direction.

Rotation of the driven gears (102) will also cause rotation, (ie tilting) of each of the louvres (100).

Figure 15:
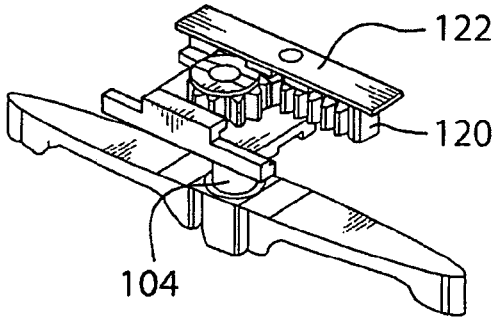
FIG. 15 is a further embodiment, in perspective of a drive gear and a single rack and housing; and, FIG. 16 is a perspective of the apparatus for drilling holes in the side frame and in the operating mechanism.

The provision of two drive racks (112) ensures trouble free operation. However in many cases a single drive rack (120) and a single control element (122) (FIG. 15) will suffice.

The driven gears (102) are formed with drive recesses (124), having keyed drive surfaces (126) therein.

The louvre axles (104) have mating key surfaces (128). When assembled the axle and gear form a locked system.

The gear has indicia, such as ribs (130) and the housing (108) has indicia in the form of notches (132).

This greatly assists assembly of the drive systems.

This form of connection, using gears and racks, can be preferable to the embodiment of FIG. 1.

In the FIG. 1 embodiment the movement of the control elements involves a semi rotary action. The control elements move closer together, (as in FIG. 2,) when the louvres are tilted closed. In the FIG. 11 embodiment the control elements move in a purely linear manner. This may be preferable for some shutters, or some installations.

To put a shutter together using either system requires fewer adjustments and measurements.

First the shutter is designed for a predetermined number of louvres, of a certain width. The spacing of the centres of the louvres is then determined, so as to achieve the desired degree of overlap.

The side frames will then be drilled out to provide openings for the end axles. It will be observed that the spacing for the pin holes in the control elements, in either embodiment, will be exactly the same as the spacing for the end axle openings.

Figure 16:
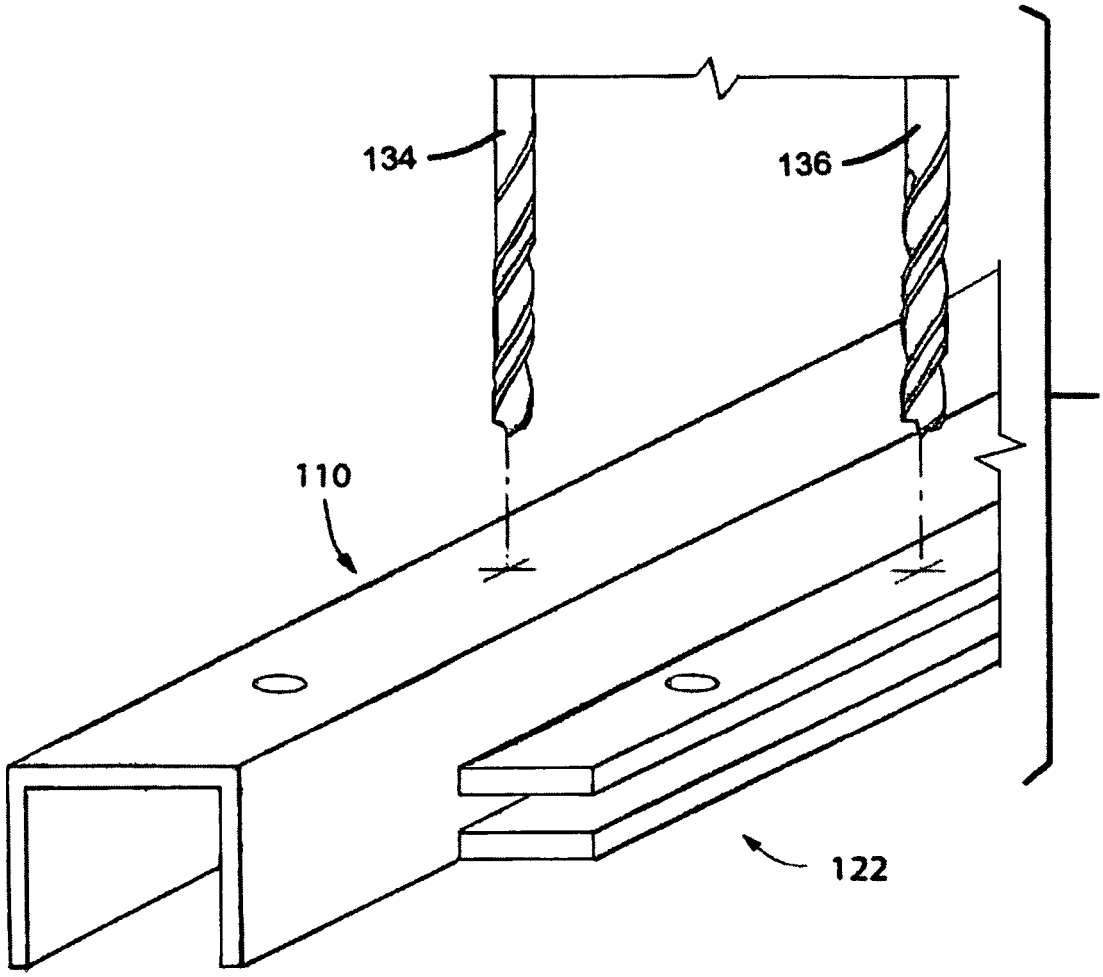

Thus to manufacture the side frames and control elements, as shown in FIG. 16, pairs of larger and smaller drills (134) and (136) can be provided which drill out both the side frames, and the control elements at the same time, on the exact same spacings. This system avoids the need for assembly of the control elements, and thereafter adjusting the setting of the individual louvres and their driven elements, as was the case in the past.

Clearly some form of manual or power operation can be provided for the control elements. Even a simple control bar will suffice. Alternatively, in many cases especially for smaller installations, it will be sufficient for the homeowner to simply tilt one of the louvres, to the desired angle. This will cause all the louvres to tilt to the same angle. Some form of braking can be incorporated in one or more of the louvres, such as is well known in the art, to hold the louvres in a desired tilt angle.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter having a rectangular frame with side frame members and end frame members, and in which at least one of the side frame members is hollow, and a plurality of louvres extending between said side frame members, and being rotatably mounted in the side frame members and a control linkage within at least one of the side frame members connecting the louvres for rotational movement in unison, further comprising;

a coupling plate secured to each said louvre in said plurality of louvres and rotatable in unison therewith;

at least one control shoe connected with each said coupling plate;

a stub pin on each said control shoe;

a stub pin opening in each said coupling plate, receiving said stub pin;

a retention pin on each said control shoe at least one control element;

retention pin holes in each said control element located at spaced intervals therealong, for rotatably receiving respective said retention pins, said control element thereby connecting said control shoes and said plurality of said louvres for movement in unison.

2. A shutter having a rectangular frame with side frame members and end frame members, as claimed in claim 1 and including end axle openings in said side frame members, and end axles extending outwardly from each end of each louvre, and extending into said end axle openings in said side frame members, and wherein said end axles openings are spaced identically with said spacing of said retention pin holes in said control elements.

3. A shutter having a rectangular frame with side frame members and end frame members, as claimed in claim 1, wherein each said end axle at each said end of each said louvre is an integrally formed unit, forming part of an end plug closing each said end of the louvre, with the end axle extending outwardly from the end plug.

4. A shutter having a rectangular frame with side frame members and end frame members, as claimed in claim 3 and including side walls and transverse walls forming said side frame members and defining hollow tubes therein.

5. A shutter having a rectangular frame with side frame members and end frame members, as claimed in claim 4 and including retention walls on one of said transverse walls.

6. A shutter having a rectangular frame with side frame members and end frame members, as claimed in claim 3 wherein said louvres are hollow and define axial interior walls spaced from one another.

7. A shutter having a rectangular frame with side frame members and end frame members, as claimed in claim 6 and including male portions on said end plugs fitting between said spaced apart interior walls in said hollow louvres.

8. A shutter having a rectangular frame with side frame members and end frame members, as claimed in claim 1 wherein both said side frame members are hollow and including two said control elements, and two said control shoes for each said louvre connecting thereto.

9. A shutter having a rectangular frame with side frame members and end frame members, as claimed in claim 1 including a gear and a gear housing in a at least one of said side frame members for each said louvre, and end axles on said louvres passing though openings in said side frame member, and into respective said gear housings, said gears being located in respective said gear housings.

10. A shutter having a rectangular frame with side frame members and end frame members, as claimed in claim 9 wherein said gear housings are generally three sided bodies, and drive racks being slidable therein for driving said gears.

11. A shutter having a rectangular frame with side frame members and end frame members, as claimed in claim 10 wherein said gear housing has two side walls and wherein respective said gear is located in respective said gear housing between said side walls, and said drive racks slide against respective said side wall.

12. A shutter having a rectangular frame with side frame members and end frame members, as claimed in claim 10 including drive pins on respective said drive racks, and drive pin holes in said control element receiving said drive pins.

* * * * *